US007273275B2

(12) United States Patent
Buchanan et al.

(10) Patent No.: US 7,273,275 B2
(45) Date of Patent: Sep. 25, 2007

(54) AIR FUNNELING INKJET PRINTHEAD

(75) Inventors: Jeffrey James Buchanan, Lexington, KY (US); Ganesh Vinayak Phatak, Lexington, KY (US); Ann Marie Trebolo, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 301 days.

(21) Appl. No.: 10/998,388

(22) Filed: Nov. 29, 2004

(65) Prior Publication Data

US 2006/0114304 A1 Jun. 1, 2006

(51) Int. Cl.
*B41J 2/175* (2006.01)
*B41J 2/19* (2006.01)

(52) U.S. Cl. ..... 347/87; 347/92; 347/93

(58) Field of Classification Search ..... 347/86, 347/87, 93, 92; 210/534, 540
See application file for complete search history.

(56) References Cited

U.S. PATENT DOCUMENTS 4,312,010 A 1/1982 Doring
4,424,521 A 1/1984 Lewis et al.
4,771,295 A 9/1988 Baker et al.
4,931,811 A 6/1990 Cowger et al.
4,967,207 A 10/1990 Ruder
5,010,354 A 4/1991 Cowger et al.
5,025,271 A 6/1991 Baker et al.
5,047,790 A 9/1991 Cowger et al.
5,317,339 A 5/1994 Braun et al.
5,376,272 A 12/1994 Spearman
5,497,178 A 3/1996 DeFosse et al.
5,502,479 A * 3/1996 Ishinaga et al. ..... 347/93
5,537,136 A 7/1996 Brandon et al.
5,576,750 A 11/1996 Brandon et al.
5,657,058 A 8/1997 Mochizuki et al.
5,659,345 A 8/1997 Altendorf
5,784,088 A 7/1998 Ujita et al.
5,812,165 A 9/1998 Boyd et al.
5,831,653 A 11/1998 Brandon et al.
5,847,735 A 12/1998 Betschon
5,886,721 A 3/1999 Fujii et al.
5,969,739 A 10/1999 Altendorf et al.
6,000,789 A 12/1999 Takagi et al.
6,033,063 A 3/2000 Tomikawa et al.
6,042,225 A 3/2000 Altendorf et al.
6,070,976 A 6/2000 Takagi et al.
6,082,852 A * 7/2000 Soga et al. ..... 347/86
6,113,223 A 9/2000 Tanaka et al.
6,155,679 A 12/2000 Sato
6,183,078 B1 2/2001 Pietrzyk et al.
6,244,697 B1 6/2001 Powers et al.
6,270,211 B1 8/2001 Long et al.
6,276,790 B1 8/2001 Ikezaki
6,290,348 B1 9/2001 Becker et al.
6,293,660 B1 9/2001 Kishida et al.

(Continued)

*Primary Examiner*—Anh T. N. Vo
(74) *Attorney, Agent, or Firm*—Dinsmore & Shohl, LLP

(57) ABSTRACT

Some embodiments of the present invention provide a inkjet printhead having an internal ink reservoir, an ink via in fluid communication with the ink reservoir, a filter tower extending into the ink reservoir, and one or more walls at the base of the filter tower. In order to promote the movement of bubbles toward and into the ink via, the wall(s) at the base of the filter tower can converge and be inclined toward the ink via, and can have one or more protrusions thereon and/or recesses therein.

26 Claims, 3 Drawing Sheets

U.S. PATENT DOCUMENTS 6,293,664 B1 9/2001 DeFosse et al.
6,299,673 B1 10/2001 Field et al.
6,325,499 B1 12/2001 Betschon
6,398,354 B1 6/2002 Lattuca et al.
6,398,850 B1 6/2002 Field et al.
6,454,399 B2 9/2002 Ujita et al.
6,457,821 B1 10/2002 Liu et al.
6,471,346 B2 10/2002 Kishida et al.
6,513,920 B1 2/2003 Deshmukh et al.
6,520,632 B1 2/2003 Yamazaki et al.
6,523,579 B1 2/2003 Tham
6,527,382 B2 3/2003 Hou et al.
6,592,215 B2 * 7/2003 Udagawa et al. ..... 347/93
6,634,742 B2 10/2003 Owaki et al.
6,648,459 B2 11/2003 Usui et al.
6,666,550 B2 12/2003 Sasaki
6,695,442 B2 2/2004 Kitahara
6,739,708 B2 5/2004 Studer et al.
6,749,295 B2 6/2004 Kim et al.
6,749,296 B2 6/2004 Usui et al.
6,761,442 B2 7/2004 Hou et al.
6,776,477 B2 8/2004 Putman et al.
6,776,479 B2 8/2004 Ardito et al.
6,783,220 B2 8/2004 Ujita et al.
7,055,942 B2 * 6/2006 Amma et al. ..... 347/93

* cited by examiner

AIR FUNNELING INKJET PRINTHEAD

BACKGROUND OF THE INVENTION

Conventional inkjet printing apparatuses (e.g., inkjet printers) typically include one or more printheads in which ink is stored. Such printheads have one or more ink reservoirs in fluid communication with nozzles through which ink exits the printhead toward a print medium. In many cases, the nozzles are located in one or more nozzle plates coupled to a body of the printhead.

A problem common to many inkjet printheads is the ability of air within the printhead to block the passage of ink. When an empty or partially empty printhead is filled with ink, air can be expelled from the printhead (e.g., through the printhead nozzles described above) to prevent such blockage. However, in many cases, some air can become trapped in one or more locations in the printhead. For example, air bubbles can become trapped within the ink reservoirs and/or between one or more filters and the downstream nozzles.

To promote evacuation of air from the printhead, many printheads are filled with ink when such printheads are at least partially inverted. In such orientations, ink can be introduced into the printhead, forcing air from the printhead through the nozzles. However, air bubbles can still remain trapped in corners, recesses, and other positions within the inverted printhead, and can move to block ink flow when the printhead is later installed in an operating orientation. For example, ink can be introduced into an inverted ink reservoir having a filter tower covered by a filter. However, air bubbles can remain in the filter tower after the ink reservoir has been filled with ink, and can later migrate to cover at least a portion of the filter when the printhead is later installed in an operating orientation. In such cases, the printhead can lose prime, thereby stopping ink flow and causing printhead failure.

SUMMARY OF THE INVENTION

Some embodiments of the present invention provide a printhead for an inkjet printing apparatus, wherein the printhead comprises a housing; an ink chamber within the housing and adapted to retain a supply of ink within the printhead; at least one aperture through which ink exits the printhead; a filter tower; a filter coupled to the filter tower and through which ink flows toward the aperture(s); and a wall in the filter tower, the wall inclined to promote movement of bubbles along the wall and having a protrusion thereon and/or an aperture therein.

In some embodiments, a printhead for an inkjet printing apparatus is provided, and comprises a housing; an ink reservoir in the housing; an ink via in fluid communication with the ink reservoir and having an upstream end and a downstream end; and a wall inclined toward the upstream end of the ink via to funnel ink toward the upstream end of the ink via, the wall having at least one of a protrusion thereon and a recess therein.

Some embodiments of the present invention provide a printhead for an inkjet printing apparatus, wherein the printhead comprises a housing; an ink reservoir shaped to retain a quantity of ink within the housing; an aperture through which ink exits the ink reservoir; at least one wall defining a funnel adjacent and upstream of the aperture; at least one of a protrusion on the at least one wall and an aperture in the at least one wall; and a filter through which ink from the ink reservoir passes, the filter located upstream of the aperture.

A more complete understanding of the present invention, together with the organization and manner of operation thereof, will become apparent from the following detailed description of the invention when taken in conjunction with the accompanying drawings, wherein like elements have like numerals throughout the drawings.

Figure 1:
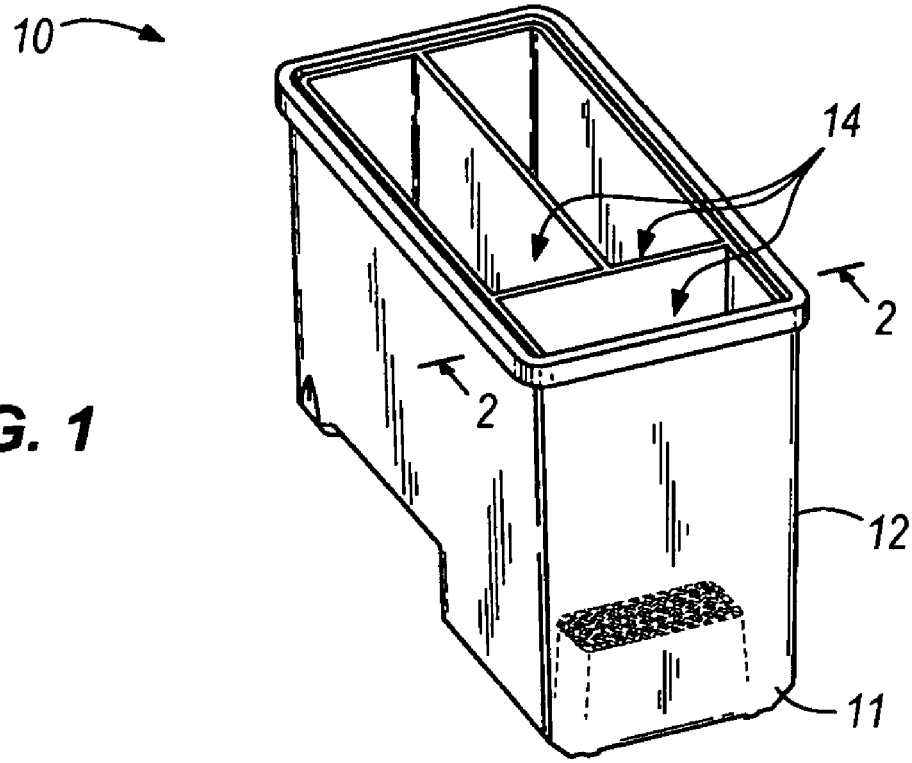
FIG. 1 is a perspective view of part of a printhead according to an embodiment of the present invention, shown with a filter tower in broken lines.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

DETAILED DESCRIPTION

Figure 2:
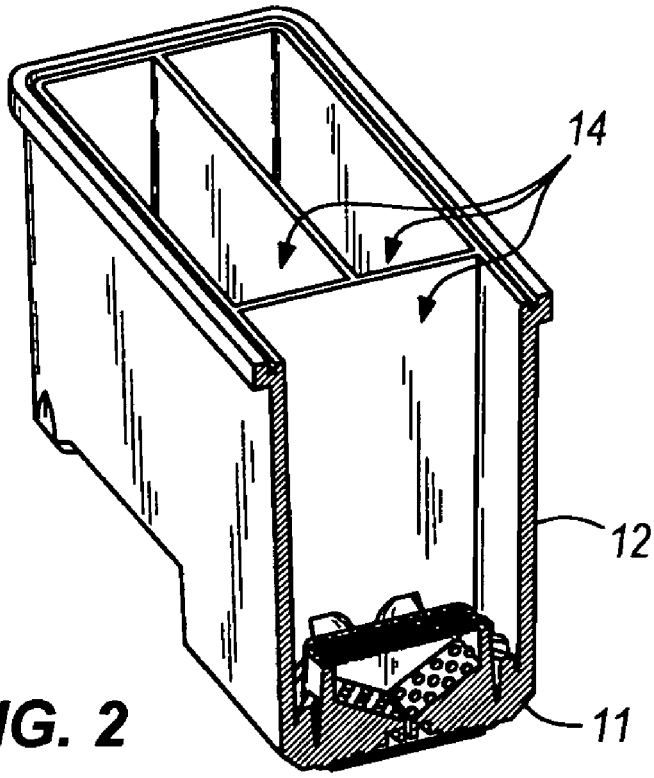
FIG. 2 is a perspective cross-sectional view of the printhead illustrated in FIG. 1, taken along lines 2-2 of FIG. 1.
Figure 3:
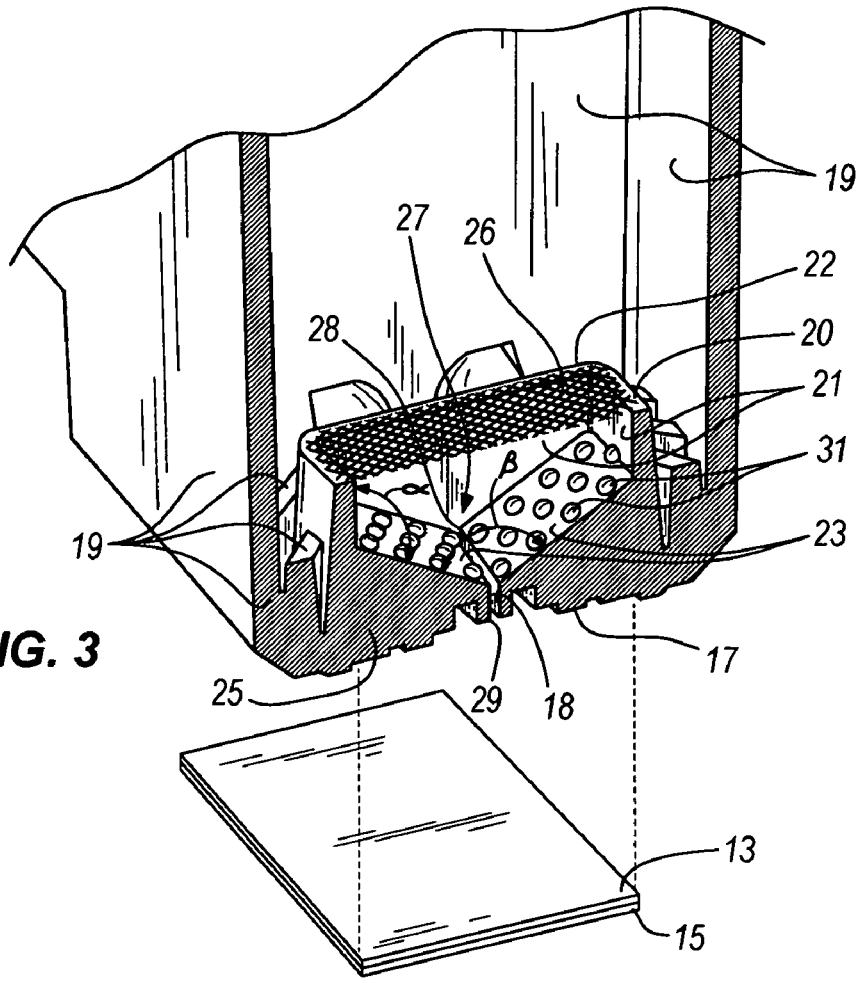
FIG. 3 is an exploded detail perspective view of the printhead illustrated in FIG. 2.

FIGS. 1-3 illustrate an inkjet printhead 10 according to an embodiment of the present invention, shown with portions of the printhead 10 removed for clarity. As shown in FIG. 1, the printhead 10 includes a housing 12 that defines a nosepiece 11 and one or more ink reservoirs 14. In other embodiments, the housing 12 can have other shapes, some of which have no identifiable nosepiece. The housing 12 can be constructed of a variety of materials, including without limitation polymers, metals, ceramics, composites, and the like.

Each ink reservoir 14 contains ink, which in some cases can at least partially saturate an insert (not shown) received within the reservoir 14. As used herein and in the appended claims, the term "ink" can refer to at least one of inks, dyes, stains, pigments, colorants, tints, a combination thereof, and any other material that can be used by an inkjet printing apparatus (e.g., an inkjet printer) to print matter upon a printing medium. As also used herein and in the appended claims, the term "printing medium" can refer to at least one of paper (including without limitation stock paper, stationary, tissue paper, homemade paper, and the like), film, tape, photo paper, a combination thereof, and any other medium upon which material can be printed by, for example, an inkjet printer.

In some embodiments, the printhead 10 has a chip 13 and a nozzle plate 15 (see FIG. 3) for ejecting ink to a printing medium. As used herein, the term "chip" refers to one or more layers of material having one or more arrays of transducers that can correspond to fluid channels, firing chambers and nozzles ("flow features") in one or more layers of a nozzle plate 15. The chip 13 can be in fluid communication with the nozzle plate 15, such as one or more ink slots in the chip 13 in fluid communication with the flow features of the nozzle plate 15. In some embodiments, one or more layers of the chip 13 are in fluid communication with one or more ink reservoirs 14 in the housing 12.

The chip 13 and the nozzle plate 15 described above can be coupled to the printhead 10 such that each of the ink reservoirs 14 is in fluid communication with a respective set of transducers and flow features in the chip 13 and nozzle plate 15, respectively. In some embodiments, the nozzle plate 15 includes only a portion of the flow features (e.g., the nozzles), and other substrates or layers positioned intermediately of the chip 13 and the nozzle plate 15 define the remaining flow features (e.g., the fluid channels and firing chambers). It should be understood that the flow features can be located or arranged in any other manner in one or more substrates or other elements.

With reference to the illustrated embodiment of FIGS. 1-3, ink is directed along a fluid path from an ink reservoir 14 toward an outer surface 17 of the housing 12, the chip 13, and the nozzle plate 15, such that the ink enters one or more firing chambers (not shown), and is eventually fired from corresponding nozzles (also not shown). As used herein, the term "fluid path" is defined with respect to macroscopic fluid flow through the printhead 10, rather than a path followed by trace amounts of ink entering and passing through the printhead 10.

Ink located in a firing chamber can be, for example, heated and vaporized by signaling a corresponding transducer in the chip 13 to heat up the ink in the firing chamber. The ink can thereby be expelled outwardly from the printhead 10 through a corresponding nozzle toward a printing medium. In some embodiments, the chip 13 is in electrical communication with a printing controller that controls when ink is ejected from various nozzles toward a printing medium.

As mentioned above, the printhead 10 can have one or more ink reservoirs 14. For example, the printhead 10 illustrated in FIGS. 1-3 has three ink reservoirs 14. Although only one of the ink reservoirs 14 and corresponding features illustrated in FIGS. 1-3 is described hereafter, it will be appreciated that the same description can apply to the other ink reservoirs of the printhead 10.

The sectioned ink reservoir 14 illustrated in FIGS. 1-3 has a number of housing walls 19, and can be covered by a lid (not shown) of the printhead 10. Also, the illustrated ink reservoir 14 has a substantially elongated rectangular shape. In other embodiments, the ink reservoir 14 can have any other shape defined by any number of walls, and need not necessarily be covered by a lid.

As illustrated in FIGS. 1-3, the printhead 10 can have a filter tower 20 located at least partially within the ink reservoir 14. The filter tower 20 can extend into the ink reservoir 14 from any direction, and can be located on any wall 19 of the printhead 10. For example, the filter tower 20 can be located at an end of an ink reservoir 14 (such as an end of an elongated ink reservoir 14) or in a location intermediate the ends of an ink reservoir 14. With reference to an orientation of the printhead 10 when the printhead 10 is installed in an inkjet printing apparatus (not shown), the filter tower 20 can be located on and extend from a bottom or side wall 19 of the ink reservoir 14. The location of the filter tower 20 can depend at least in part upon the location of an ink via 18 (discussed in greater detail below) through which ink passes to exit the ink reservoir 10. For example, in the installed orientation of the printhead 10 illustrated in FIGS. 1-3, the filter tower 20 is located at a bottom of the ink reservoir 14, and extends substantially vertically into the ink reservoir 14.

The filter tower 20 can be defined by any number of walls 21. For example, the filter tower 20 in the illustrated embodiment has four walls 21 defining a substantially rectangular cross-sectional shape. As another example, the filter tower 20 can have walls 21 defining a round, oval, trapezoidal, irregular, or other cross-sectional shape. In addition, the walls 21 of the filter tower 20 can have any length desired (i.e., can extend any distance from a wall 19 of the housing 12).

In some embodiments, a filter 26 can be coupled to the filter tower 20 to filter ink as ink flows from the ink reservoir 14 toward the ink via 18. The filter 26 can be coupled to the filter tower 20 in any of a variety of manners known in the art (e.g., laser welding, adhesive or cohesive bonding material, heat staking, etc.). A variety of types of filters can be used in conjunction with the present invention. For example, a woven filter 26 with a relatively fine mesh size can be used, if desired. In other embodiments, no filter is used.

With continued reference to the embodiment of FIGS. 1-3, the filter tower 20 can have a terminal end 22 to which a filter 26 can be coupled in any of the manners described above. In other embodiments, a filter 26 can be coupled to the filter tower 20 in any location along the filter tower 20 or at an end of the filter tower 20 opposite the terminal end 22. In such embodiments, the filter 26 can be secured directly to the walls 21 of the filter tower 20, to one or more steps, bosses, or other features extending from or located in the filter tower walls 21, and the like.

As best shown in FIG. 3, the illustrated printhead 10 has a pair of walls 23 that are inclined with respect to the ink via 18. In other words, the walls 23 are inclined to converge toward the ink via 18. The inclined walls 23 are located at a base 25 of the filter tower 20 (i.e., adjacent a housing wall 19 or other housing feature from which the filter tower 20 extends). The inclined walls 23 can at least partially define a funnel 27 leading toward the ink via 18. In some embodiments, the funnel 27 can also be defined by one or more walls 21 of the filter tower 20 and/or one or more housing walls 19. For example, the funnel 27 illustrated in the embodiment of FIGS. 1-3 includes the inclined walls 23 and side walls 21 of the filter tower 20. Accordingly, it should be noted that not all walls of the funnel 27 need to be inclined toward the ink via 18.

The inclined walls 23 illustrated in FIGS. 2 and 3 are substantially planar. However, either or both of the inclined walls 23 can be curved in any direction. For example, the cross-sectional shape of the inclined walls 23 in a direction toward the ink via 18 (e.g., see FIGS. 2 and 3) can be substantially straight, or can instead be curved to present a concave or convex shape toward the interior of the filter tower 20. As another example, the cross-sectional shape of either or both inclined walls 23 defined by a plane not passing through the ink via 18 (e.g., a plane perpendicular to the cross section illustrated in FIGS. 2 and 3) can be substantially straight, or can instead be curved to present a concave or convex shape toward the interior of the filter tower 20.

The printhead 10 illustrated in FIGS. 1-3 has two inclined walls 23 located at an end of the filter tower 20. In other embodiments, any other number of inclined walls 23 can be located as described above, wherein each such wall 23 is inclined toward the ink via 18. For example, in some embodiments, a single wall 23 extends toward and is inclined toward the ink via 18, such as a single inclined wall 23 extending substantially entirely across the base 25 of the filter tower 20 toward an ink via 18 located at a side of the filter tower base 25. As other examples, three or more walls 23 can converge and be inclined toward the ink via 18 to form an inverted symmetrical or non-symmetrical conical or frusto-conical shape, an inverted symmetrical or non-symmetrical pyramidal or frusto-pyramidal shape, and the like. Still other shapes employing any number of inclined walls are possible, and fall within the spirit and scope of the present invention. By virtue of the inclined wall(s) 23 described herein, at least a portion of the filter tower 20 can have a shrinking cross-sectional area with closer proximity to the ink via 18.

In the illustrated embodiment of FIGS. 1-3, each inclined wall 23 extends from a wall 21 of the filter tower 20 to an entrance 28 of the ink via 18. In other embodiments, some or all of the inclined walls 23 need not necessarily extend from walls 21 of the filter tower 20, and need not necessarily extend fully to the entrance 28 of the ink via 18. Also with reference to the embodiment of FIGS. 1-3, each inclined wall 23 extends from a location approximately half way along the length of the filter tower 20 to the base 25 of the filter tower 20. In other embodiments, some or all of the inclined walls 23 can extend along other portions of the filter tower 20, such as along a third or quarter of the filter tower 20 closest to the base 25, along substantially the entire length of the filter tower 20, and the like.

Ink from the ink reservoir 14 flows through the ink via 18 to exit the printhead 10 (e.g., through a chip 13, nozzle plate 15, and/or other elements as described above). The ink via 18 extends between an entrance 28 and an downstream exit 29. In some embodiments, the exit 29 of the ink via 18 is located immediately adjacent a chip 13 and/or a nozzle plate 15. In other embodiments, the exit 29 of the ink via 18 opens to a feed tube, chamber, or other feature of the printhead 10 upstream of the chip 13 and/or nozzle plate 15.

The ink via 18 can have any length, and can extend in any direction or combination of directions desired. For example, the ink via 18 best illustrated in FIG. 3 extends a relatively small and substantially vertical distance (with reference to the operational orientation of the printhead 10 illustrated in FIGS. 1-3). Although not visible in FIGS. 1-3, the ink vias 18 from the other ink reservoirs 14 extend a longer and diagonal distance toward the chip 13 and nozzle plate 15. Also, the ink vias 18 can be substantially straight or can follow any bent or curved path from the respective ink reservoirs 14.

With reference again to FIGS. 1-3, the entrance 28 and exit 29 of the ink via 18 are substantially elongated. In other embodiments, the entrance 28 and exit 29 of the ink via 18 can have any other shape, including round, oval, or irregular shapes, and need not necessarily have the same shape. For example, in embodiments in which the inclined walls 23 are shaped to form an inverted conical funnel 27 as described above, the entrance 28 of the ink via 18 can be round (although any other shape is possible in such embodiments).

In addition, the entrance 28 of the ink via 18 extends substantially entirely between opposite sides of the filter tower 20. However, the entrance 28 can instead extend less than this distance, if desired.

The entrance 28 of the ink via 18 illustrated in FIGS. 1-3 is substantially centrally located between opposite sides of the filter tower 20. Depending at least in part upon the position and orientation of the inclined wall(s) 23, the entrance 28 of the ink via 18 can be located in any other position with respect to the filter tower 20. For example, the entrance of the ink via 18 can be located adjacent a side of the filter tower 20, such as an elongated entrance 28 running alongside a wall 21 of the filter tower 20, an entrance 28 located in a corner of the filter tower base 25, an entrance 28 located in any off-center position with respect to the filter tower base 25, or an entrance 28 located in any other position within the walls 21 of the filter tower 20. In such alternative embodiments, any number of inclined walls 23 can be positioned and oriented to converge toward and be inclined with respect to the entrance 28 of the filter tower 20 as described above.

In the process of filling the ink reservoir 14 with ink, it can be necessary to remove air or other gasses or combinations of gases (e.g., bubbles) from within the filter tower 20. To perform this function, the printhead 10 can be inverted from the installed and operational position illustrated in FIGS. 1-3 as ink is introduced into the ink reservoir 14. Air within the filter tower 20 can thereby be forced through the ink via 18 and out of the printhead 10. The inclined walls 23 can promote movement of air toward and into the ink via 18. In this regard, the slope of the walls 23 can impact the ability of air to move toward the entrance 28 of the ink via 18. In some embodiments, one or more of the inclined walls 23 is inclined to define an angle $\alpha$ between the inclined wall 23 and an adjacent filter tower wall 21 of greater than about 90 degrees, and in some embodiments, the angle $\alpha$ is equal to or greater than about 102 degrees, but less than 180 degrees. In the embodiment illustrated in FIGS. 1-3, for example, the angle $\alpha$ is about 120 degrees. As described in greater detail above, two or more inclined walls 23 can converge and be inclined toward the entrance 28 of the ink via 18. In some embodiments, adjacent inclined walls 23 on opposite sides of the entrance 28 define an angle $\beta$ therebetween of greater than 0 degrees but less than 180 degrees. In some embodiments, the angle $\beta$ is less than 156 degrees. In the embodiment illustrated in FIGS. 1-3, the angle $\beta$ is about 120 degrees.

In some embodiments of the present invention, one or more of the inclined walls 23 has one or more protrusions 31 extending toward the interior of the filter tower 20. In the illustrated embodiment of FIGS. 1-3, the protrusions 31 are bumps, although the protrusions 31 can instead be pins, posts, or other features protruding toward the interior of the filter tower 20. The protrusions 31 can have any shape desired, including round, square, diamond, star, oval, irregular, or other shapes. In addition, the protrusions 31 can have any size desired.

A number of protrusions 31 can be distributed across the inclined walls 23 in a patterned or patternless manner. For example, the protrusions 31 illustrated in FIGS. 2 and 3 are distributed in a grid across the inclined walls 23. In some embodiments, the protrusions 31 are spaced from one another across the surfaces of the inclined walls 23. However, the protrusions 31 need not necessarily be separated from one another as shown in the embodiment of FIGS. 1-3. Instead, any fraction or all of the protrusions 31 can be touching in order to form one or more networks of connected protrusions 31. Although substantially the entire surfaces of both inclined walls 23 in FIGS. 2 and 3 are covered with protrusions 31, less than all inclined walls 23 and/or less than all surfaces of each inclined wall 23 are covered with protrusions 31 in other embodiments. For example, protrusions 31 can instead be located on only those areas of the inclined walls 23 that are adjacent the filter tower walls 21, or on only those areas of the inclined walls 23 that are adjacent the entrance 28 to the ink via 18.

The protrusions 31 on the inclined walls 23 can function to reduce the amount of surface area to which bubbles can cling, thereby enabling movement of bubbles along the inclined walls 23. In some embodiments, the combination of the protrusions 31 and the inclined walls 23 can therefore promote movement of bubbles out of the filter tower 20, toward the entrance 28 of the ink via 18, and into the ink via 18.

Figure 4:
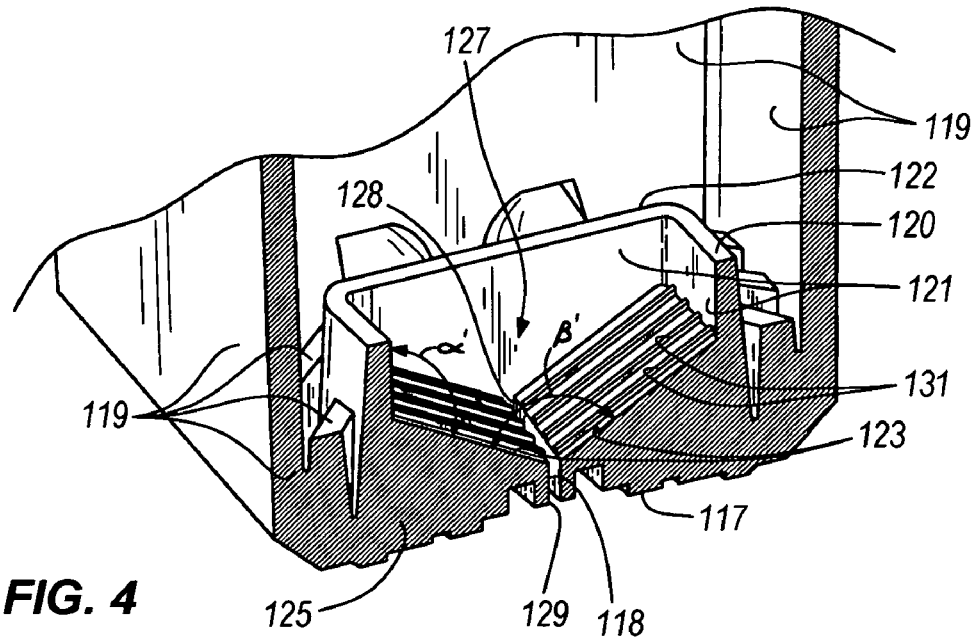
FIG. 4 is a detail perspective view of a printhead according to another embodiment of the present invention.

FIG. 4 illustrates a printhead 110 according to another embodiment of the present invention, wherein like numerals represent like elements with respect to the printhead 10 illustrated in FIGS. 1-3. The printhead 110 shares many of the same elements and features described above with reference to the printhead 10 of FIGS. 1-3. Accordingly, elements and features corresponding to elements and features of the printhead 10 of FIGS. 1-3 are provided with the same reference numerals in the 100 series. Reference is made to the description above accompanying FIGS. 1-3 for a more complete description of the features and elements (and alternatives to such features and elements) of the printhead 110 illustrated in FIG. 4.

Like the printhead 10 described above and illustrated in FIGS. 1-3, the printhead 110 illustrated in FIG. 4 has an ink reservoir 114, a number of housing walls 119 at least partially defining the ink reservoir 114, an ink via 118 extending from an entrance 128 in fluid communication with the ink reservoir 114 and an exit 129 through which ink exits the ink via 118, and a filter tower 120 having a base 125, walls 121 extending into the ink reservoir 114, inclined walls 123 at the base 125 of the filter tower 120, and a filter (not shown). The protrusions 131 illustrated in FIG. 4 are elongated ribs, and represent another example of the various forms the protrusions can take in different embodiments of the present invention. Each elongated protrusion 131 illustrated in FIG. 4 can have any cross-sectional shape desired, including without limitation rounded, triangular, rectangular, and other cross-sectional shapes. Also, each elongated protrusion 131 can be substantially straight as shown, or can extend along any surface of the inclined wall(s) 123 in any other manner, such as in a diagonal, zigzag, curved, or other manner or combination of manners. In some embodiments, the inclined walls 123 have multiple elongated protrusions 131 defining a corrugated surface of alternating peaks and valleys across the inclined walls 123. These peaks and valleys can have any cross-sectional shape, such as substantially sinusoidal or square wave shapes, cross-sectional shapes with pointed peaks and/or valleys, and the like.

The elongated protrusions 131 illustrated in FIG. 4 extend along the inclined walls 123 generally in a direction toward the entrance 128 of the ink via 118, and extend substantially fully across the inclined walls 123. However, in other embodiments, the elongated protrusions 131 extend in any other direction or combination of directions, and can extend across any portion of the inclined walls 123.

With continued reference to the embodiment illustrated in FIG. 4, the elongated protrusions 131 are spaced from one another across the inclined walls 123, and can be distributed on the inclined walls 123 in equally or non-equally spaced manners.

Although substantially the entire surfaces of both inclined walls 123 in FIG. 4 are covered with elongated protrusions 131, less than all inclined walls 123 and/or less than all surfaces of each inclined wall 123 are covered with elongated protrusions 131 in other embodiments. For example, elongated protrusions 131 can instead be located on only those areas of the inclined walls 123 that are adjacent the filter tower walls 121, or on only those areas of the inclined walls 123 that are adjacent the entrance 128 to the ink via 118.

Like the other types of protrusions 131 on the inclined walls 123 described above, the elongated protrusions 131 can function to reduce the amount of surface area to which bubbles can cling, thereby enabling movement of bubbles along the inclined walls 123. The combination of the elongated protrusions 131 and the inclined walls 123 can therefore promote movement of bubbles out of the filter tower 120, toward the entrance 128 of the ink via 18, and into the ink via 18.

As described above, the protrusions 31, 131 on the inclined walls 23, 123 can have any shape desired. Although the inventors have discovered that the bump and rib-shaped protrusions 31, 131 illustrated in FIGS. 1-4 provide good performance results, protrusions having other shapes can instead be used, and fall within the spirit and scope of the present invention.

Figure 5:
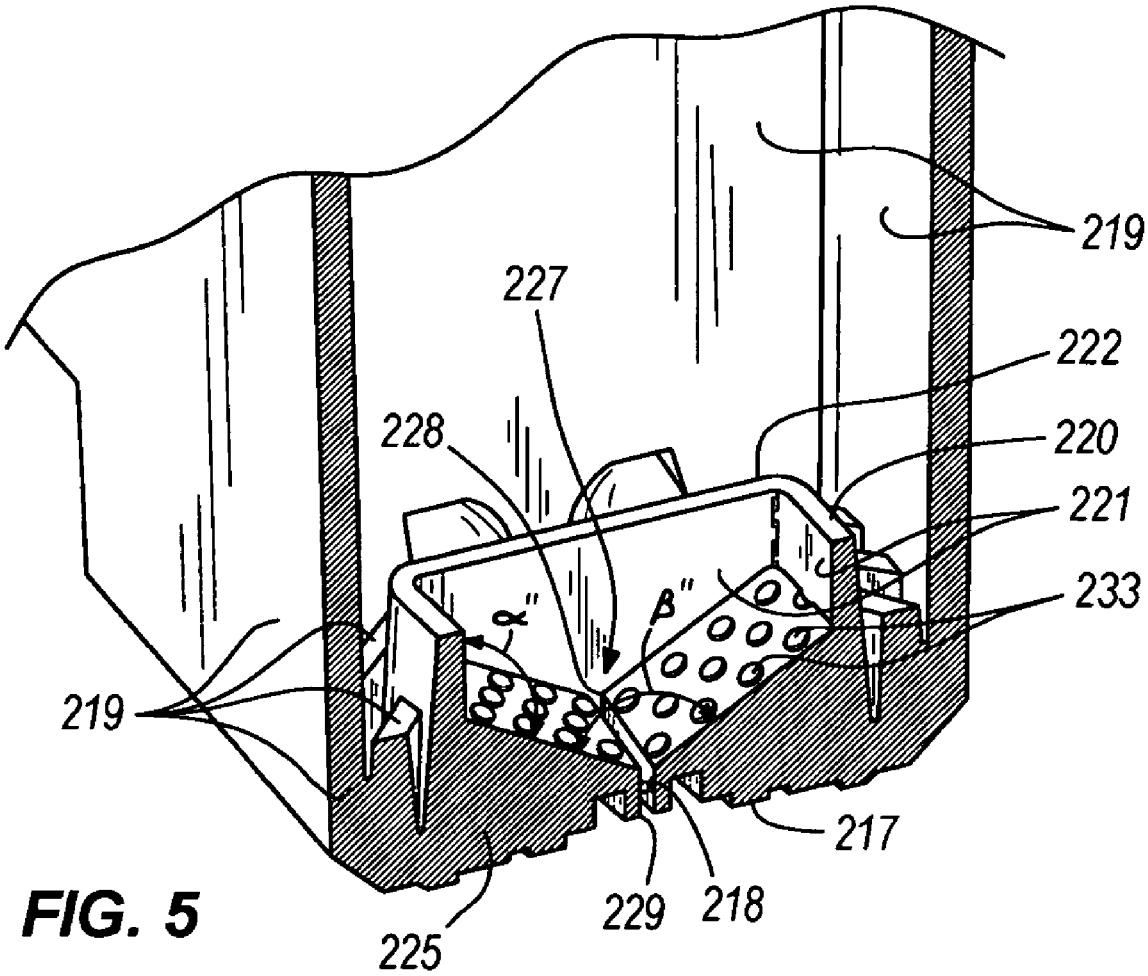
FIG. 5 is a detail perspective view of a printhead according to yet another embodiment of the present invention.

FIG. 5 illustrates a printhead 210 according to another embodiment of the present invention, wherein like numerals represent like elements with respect to the printhead 10 illustrated in FIGS. 1-3. The printhead 210 shares many of the same elements and features described above with reference to the printhead 10 of FIGS. 1-3. Accordingly, elements and features corresponding to elements and features of the printhead 10 of FIGS. 1-3 are provided with the same reference numerals in the 200 series. Reference is made to the description above accompanying FIGS. 1-3 for a more complete description of the features and elements (and alternatives to such features and elements) of the printhead 210 illustrated in FIG. 5.

Like the printhead 10 described above and illustrated in FIGS. 1-3, the printhead 210 illustrated in FIG. 5 has an ink reservoir 214, a number of housing walls 219 at least partially defining the ink reservoir 214, an ink via 218 extending from an entrance 228 in fluid communication with the ink reservoir 214 and an exit 229 through which ink exits the ink via 218, and a filter tower 220 having a base 225, walls 221 extending into the ink reservoir 214, inclined walls 223 at the base 225 of the filter tower 220, and a filter (not shown). However, the printhead 210 illustrated in FIG. 5 has a plurality of recesses 233 across the surfaces of the inclined walls 223 (rather than protrusions as described above). The recesses 233 can have any shape desired, including round, square, elongated, diamond, star, oval, irregular, or other shapes. In addition, the recesses 233 can have any size desired.

A number of recesses 233 can be distributed across the inclined walls 223 in a patterned or patternless manner. For example, the recesses 233 illustrated in FIG. 5 are distributed in a grid across the inclined walls 223. In some embodiments, the recesses 233 are spaced from one another across the surfaces of the inclined walls 223. However, the recesses 233 need not necessarily be separated from one another as shown in the embodiment of FIG. 5. Instead, any fraction or all of the recesses 233 can be touching in order to form one or more networks of connected recesses 233. Although substantially the entire surfaces of both inclined walls 223 in FIG. 5 are covered with recesses 233, less than all inclined walls 223 and/or less than all surfaces of each inclined wall 223 are covered with recesses 233 in other embodiments. For example, recesses 233 can instead be located on only those areas of the inclined walls 223 that are adjacent the filter tower walls 221, or on only those areas of the inclined walls 223 that are adjacent the entrance 228 to the ink via 218.

Like the protrusions 31, 131 described above with reference to FIGS. 1-4, the recesses 233 on the inclined walls 223 can function to reduce the amount of surface area to which bubbles can cling, thereby enabling movement of bubbles along the inclined walls 223. In some embodiments, the combination of the recesses 233 and the inclined walls 223 can therefore promote movement of bubbles out of the filter tower 220, toward the entrance 228 of the ink via 218, and into the ink via 218.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, the embodiments described above with reference to FIGS. 1-5 have protrusions 31, 131 or recesses 233 on the inclined walls 23, 123, 223. In other embodiments, the inclined walls 23, 123, 223 have any combination of protrusions 31, 131 and recesses 233, such as inclined walls 23, 123, 223 having alternating bumps and recesses 233, inclined walls 23, 123, 223 having alternating ribs and recesses 233, or inclined walls 23, 123, 223 having alternating bumps and ribs, and the like.

As another example, the embodiments of the present invention described above refer to a filter tower 20, 120, 220 extending into the ink reservoir 14, 114, 214, and one or more inclined walls 23, 123, 223 located within the filter tower 20, 120, 220. However, it should be noted that the inclined walls 23, 123, 223 need not necessarily be located within a filter tower 20, 120, 220 to still converge and be inclined toward the entrance 28, 128, 228 of the ink via 18, 118, 218 (in which case angle $\alpha$, $\alpha'$, $\alpha''$ can be measured between one or more inclined walls 23, 123, 223 and an adjacent wall of the housing 12, 112, 212). The inclined walls 23, 123, 223 can be located in any other position in the ink reservoir 14, 114, 214 still providing this relationship with respect to the entrance 28, 128, 22 of the ink via 18, 118, 218. In this regard, the printhead 10, 110, 210 need not necessarily have a filter tower 20, 120, 220 and/or filter 26, 126, 226 in order to apply many of the principles of the present invention.

What is claimed is:

1. A printhead for an inkjet printing apparatus, the printhead comprising:

a housing;

an ink chamber within the housing and adapted to retain a supply of ink within the printhead;

at least one aperture through which ink exits the printhead;

a filter tower;

a filter coupled to the filter tower and through which ink flows toward the at least one aperture;

a wall in the filter tower, the wall inclined to promote movement of bubbles along the wall; and a protrusion disposed on the wall, the protrusion extending away from the wall but stopping short of the filter.

2. The printhead as claimed in claim 1, wherein the filter tower extends into the ink chamber.

3. The printhead as claimed in claim 1, wherein the wall is a first wall, the printhead her comprising a second wall in the filter tower and also in lined to promote movement of bubbles along the second wall, the first and second walls converging and inclined with respect to one another to at least partially define a funnel.

4. The printhead as claimed in claim 1, further comprising a via in the housing extending from an entrance of the via adjacent the wall and an exit of the via downstream of the entrance.

5. The printhead as claimed in claim 4, wherein the entrance of the via has an elongated shape.

6. The printhead as claimed in claim 4, wherein the wall is a first wall, the printhead further comprising a second wall in the filter tower, wherein the first and second walls converge toward one another and the entrance of the via.

7. The printhead as claimed in claim 1, wherein the protrusion is elongated and extends in a direction toward an end of the filter tower.

8. The printhead as claimed in claim 1, wherein the wall is located at an end of the ink chamber.

9. The printhead as claimed in claim 1, wherein the wall has a plurality of protrusions in spaced relationship across the wall.

10. A printhead for an inkjet printing apparatus, the printhead comprising:

a housing;

an ink reservoir in the housing;

an ink via in fluid communication with the ink reservoir and having an upstream end and a downstream end;

a wall inclined toward the upstream end of the ink via to funnel ink toward the upstream end of the ink via, and a recess disposed in the wall, the recess comprising an indentation in the surface of the wall.

11. The printhead as claimed in claim 10, further comprising a filter located between the ink reservoir and the ink via.

12. The printhead as claimed in claim 10, wherein the wall is a bottom wall of the ink reservoir.

13. The printhead as claimed in claim 10, wherein the wall defines at least part of a funnel leading to the ink via.

14. The printhead as claimed in claim 10, wherein the wall is a first wall, the printhead further comprising a second wall inclined toward the upstream end of the ink via to funnel ink toward the upstream end of the ink via, wherein the first and second walls converge and are inclined toward one another.

15. The printhead as claimed in claim 10, further comprising a filter tower extending from the ink reservoir to the upstream end of the ink via and to which a filter is coupled, wherein the wall is located at an end of the filter tower adjacent the upstream end of the ink via.

16. The printhead as claimed in claim 10, wherein the recess is elongated and extends in a direction toward the upstream end of the ink via.

17. The printhead as claimed in claim 10, wherein the wall has a plurality of recesses in spaced relationship across the wall.

18. The printhead as claimed in claim 10, wherein the ink via has an elongated entrance at the upstream end.

19. A printhead for an inkjet printing apparatus, the printhead comprising:

a housing;

an ink reservoir shaped to retain a quantity of ink within the housing an aperture through which ink exits the ink reservoir;

at least one wall defining funnel adjacent and upstream of the aperture;

at least one groove cut into the wall; and a filter through which ink from the ink reservoir passes, the filter located upstream of the aperture.

20. The printhead as claimed in claim 19, wherein the aperture is an entrance of an ink via extending from the funnel.

21. The printhead as claimed in claim 19, wherein the funnel comprises two walls converging and inclined toward one another and the aperture through which ink exits the ink reservoir.

22. The printhead as claimed in claim 21, wherein the two walls converage at an angle of less than 156 degrees.

23. The printhead as claimed in claim 19, wherein the funnel is located at an end of the ink reservoir.

24. The printhead as claimed in claim 19, wherein the at least one groove extends in a direction toward the upstream end of the ink via.

25. The printhead as claimed in claim 19, wherein the wall has a plurality of substantially parallel grooves cut into the wall.

26. The printhead as claimed in claim 19, wherein the aperture through which ink exits the ink reservoir is substantially elongated in shape.

* * * * *